US008808052B2

(12) United States Patent
Yang

(10) Patent No.: US 8,808,052 B2
(45) Date of Patent: Aug. 19, 2014

(54) INTERACTIVE ELECTRONIC TOY

(75) Inventor: Sam Yang, Taipei (TW)

(73) Assignee: Sap Link Technology Corp., Taipei (TW)

( * ) Notice: Subject to any disclaimer, the term of this patent is extended or adjusted under 35 U.S.C. 154(b) by 272 days.

(21) Appl. No.: 13/416,562

(22) Filed: Mar. 9, 2012

(65) Prior Publication Data

US 2013/0165014 A1 Jun. 27, 2013

(51) Int. Cl.
*A63H 30/00* (2006.01)

(52) U.S. Cl.
USPC ..... 446/175

(58) Field of Classification Search
USPC ..... 446/91, 175, 295, 297, 298, 484
See application file for complete search history.

(56) References Cited

U.S. PATENT DOCUMENTS

| | | | | |
|---|---|---|---|---|
| 6,053,797 | A | 4/2000 | Tsang et al. | |
| 6,290,566 | B1 * | 9/2001 | Gabai et al. | 446/175 |
| 6,514,117 | B1 * | 2/2003 | Hampton et al. | 446/301 |
| 6,585,556 | B2 * | 7/2003 | Smirnov | 446/175 |
| 6,604,980 | B1 * | 8/2003 | Jurmain et al. | 446/296 |
| 6,699,045 | B2 * | 3/2004 | Christianson et al. | 434/262 |
| 6,773,322 | B2 * | 8/2004 | Gabai et al. | 446/91 |
| 7,025,657 | B2 * | 4/2006 | Nishimoto | 446/484 |
| 7,507,139 | B1 * | 3/2009 | Maddocks et al. | 446/282 |
| 7,695,341 | B1 | 4/2010 | Maddocks et al. | |
| 8,092,271 | B2 * | 1/2012 | Garbos et al. | 446/298 |
| 8,414,346 | B2 * | 4/2013 | Jurmain et al. | 446/175 |
| 2002/0081937 | A1 * | 6/2002 | Yamada et al. | 446/175 |
| 2011/0065354 | A1 * | 3/2011 | Wolfe et al. | 446/297 |
| 2013/0065482 | A1 * | 3/2013 | Trickett | 446/397 |

* cited by examiner

*Primary Examiner* — Kurt Fernstrom
(74) *Attorney, Agent, or Firm* — Muncy, Geissler, Olds & Lowe, P.C.

(57) ABSTRACT

An interactive electronic toy includes a body, a sensor module, a data storage module, an output module and a processing unit. The sensor module generates sensing signals when the body is being operated. The data storage module has stored therein standard status parameters each having an accurate response signal. The processing unit runs an operation mode subject to the steps of: receiving the sensing signals and processing the sensing signal into an actual parameter, receiving the standard status parameters, matching the actual parameters with the standard status parameters, and outputting to the output module the accurate response signal of the standard status parameter that matches the actual parameter.

14 Claims, 6 Drawing Sheets

INTERACTIVE ELECTRONIC TOY

BACKGROUND OF THE INVENTION

1. Field of the Invention

The present invention relates to interactive electronic toys and more particularly, to an interactive electronic toy that provides interaction, imitation and learning modes.

2. Description of the Related Art

With the advances in technology, toys of different shapes have been continuously created. For example, U.S. Pat. No. 7,695,341 discloses an electromechanical toy, U.S. Pat. No. 6,585,556 discloses a talking toy, U.S. Pat. No. 6,053,797 discloses an interactive toy. These toys commonly provide an interactive function. For example, the electromechanical toy of U.S. Pat. No. 7,695,341 includes a sensor that senses a condition, a movable region shaped like the head of, for example, a cat, and an actuator coupled to the movable region to move the movable region in a direction relative to the sensed condition. The movable region is coupled to a body that houses electromechanical components for sensing conditions and for moving the movable region in response to the detected conditions. However, this interactive motion is monotonous.

SUMMARY OF THE INVENTION

The present invention has been accomplished under the circumstances in view. It is the main object of the present invention to provide an interactive electronic toy, which provides an interactive response on the real time by means of a sensing signal matching procedure, enabling the interactive electronic toy to simulate the represented role and improving the monotonous interaction of the direct response type prior art technique.

To achieve this and other objects of the present invention, an interactive electronic toy comprises a body, a sensor module, a data storage module, an output module and a processing unit. The sensor module, the data storage module, the output module and the processing unit are mounted within the body. When the body is been operated, the sensor module generates multiple sensing signals. The data storage module has stored therein standard status parameters. Each standard status parameter comprises an accurate response signal. The processing unit runs an operation mode subject to the steps of: receiving the sensing signals and processing the sensing signals into an actual parameter, receiving the standard status parameters, matching the actual parameter with one of the standard status parameters, and outputting to the output module the accurate response signal of the standard status parameter that matches the actual parameter.

Preferably, the processing unit is capable of running a learning mode by: selecting one from the standard status parameters; setting the selected standard status parameter as a learning pattern; and storing the learning pattern.

Preferably, each standard status parameter further comprises an inaccurate response signal. Further, the processing unit is controllable to run an imitation mode subject to the steps of: receiving the sensing signals; processing the sensing signals into respective the actual parameter; receiving the standard status parameter corresponding to the learning pattern; matching the actual parameter with the standard status parameter; and outputting the accurate response signal of the standard status parameter to the output module when the actual parameter matches the standard status parameter, or inaccurate response signal of the standard status parameter to the output module when not matched.

When compared to prior art techniques, the interactive electronic toy of the invention uses the sensor module to detect various different postures or actions of the body and provide respective interactive responses, simulating the motion of a human being, animal or plant, and enhancing interaction between the toy and the game player. Further, the learning and imitation modes of the interactive electronic toy enable one game player to establish a model action by means of learning, and then to provide the model action to other game players for imitation, thereby improving the technical problems of the prior art designs.

Other advantages and features of the present invention will be fully understood by reference to the following specification in conjunction with the accompanying drawings, in which like reference signs denote like components of structure.

DETAILED DESCRIPTION OF THE INVENTION

Figure 1:
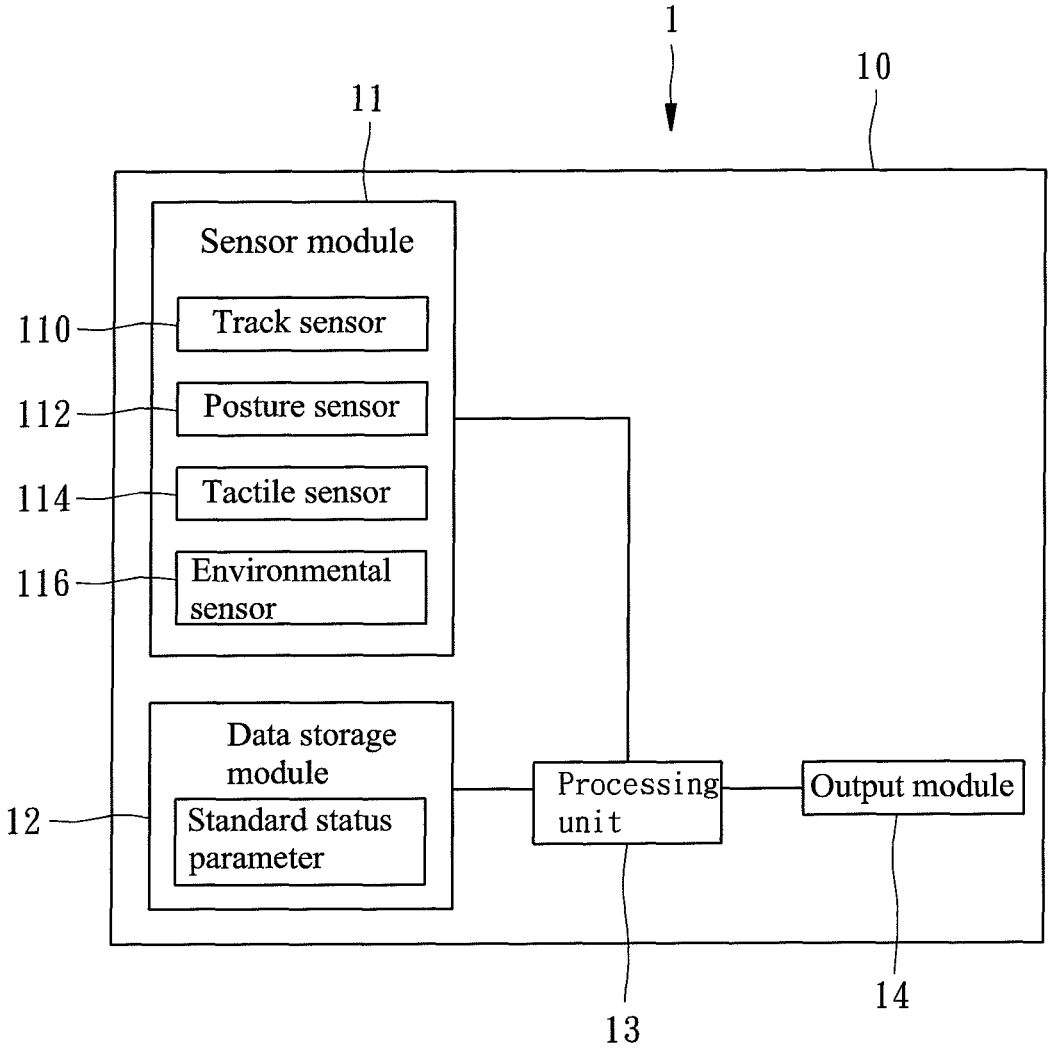
FIG. 1 is a block diagram of an interactive electronic toy in accordance with the present invention.
Figure 2:
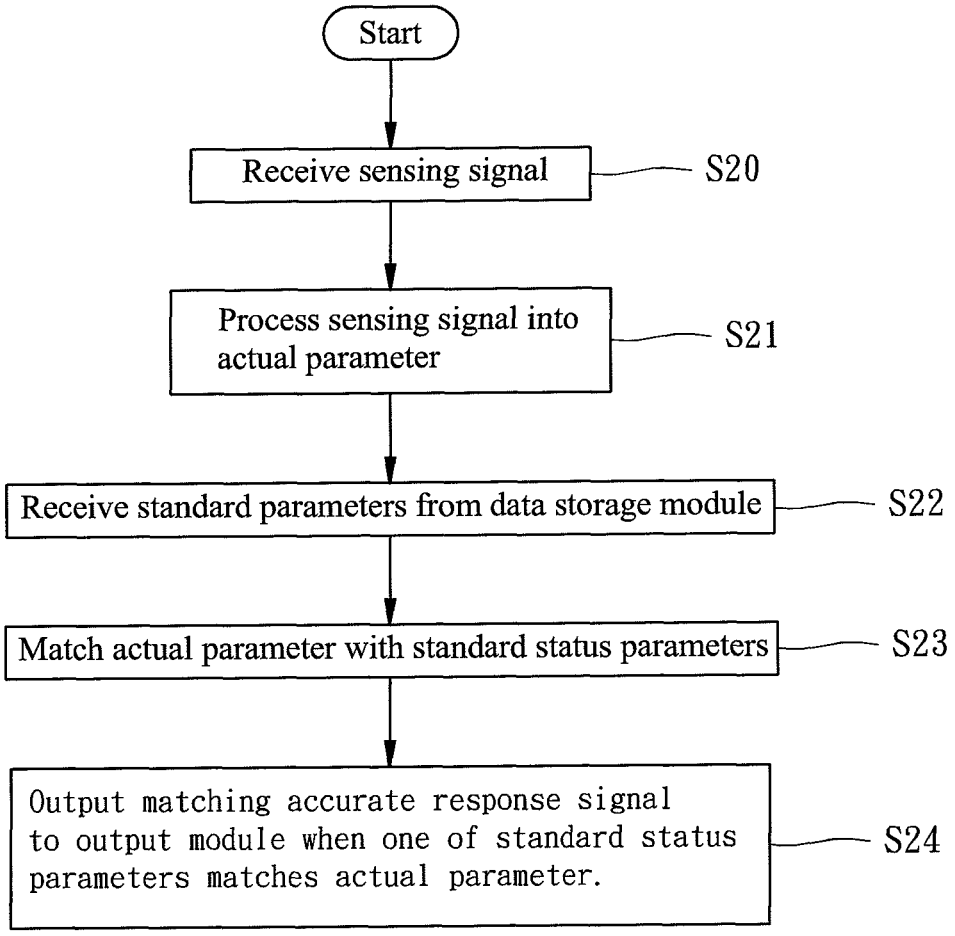
FIG. 2 is an operation flow of the processing unit of the interactive electronic toy in accordance with the present invention under an operation mode (I).

Referring to FIGS. 1 and 2, a block diagram of an interactive electronic toy and an operation flow of a processing unit of the interactive electronic toy under the operation mode in accordance with the present invention are shown. The interactive electronic toy 1 comprises a body 10, a sensor module 11, a data storage module 12, an output module 14 and a processing unit 13. The body 10 can be a doll, toy dog, toy cat, toy bird, toy tree, or any toy physical object. Further, the surface of the body 10 is preferably prepared by nonwoven fabric, fur or silicone rubber.

The sensor module 11 is mounted in the body 10 for generating multiple sensing signals corresponding to motions of the body 10 when the body 10 is being operated by a person. In this embodiment, the sensor module 11 comprises at least one track sensor 110, at least one posture sensor 112, at least one tactile sensor 114 and at least one environmental sensor 116.

Each track sensor 110 is adapted for sensing the continuous track of the movement of the body 10 and generating a continuous series of sensing signals corresponding to the movement of the body 10. The at least one track sensor 110 is preferably selected from the group of acceleration sensor, gyroscope and geomagnetic sensor. The at least one track sensor 110 can sense the continuous track of the movement of the body 10 (for example, the body 10 being picked up or put down). In actual application, the at least one track sensor 110 is not limited to the aforesaid choices. Any other design capable of sensing a continuous movement track of the body 10 and generating corresponding sensing signals can be used.

Every posture sensor 112 is adapted for sensing postures of the body 10 and generating corresponding sensing signals. The at least one posture sensor 112 is preferably selected from the group of acceleration sensor and gyroscope. The at least one posture sensor 112 can sense a posture variation of the body 10 when the body is being moved, for example, the postures of tilting, body reversing, trembling, shaking, knocking, falling, lifting, turning and padding. In actual application, the at least one posture sensor 112 is not limited to the aforesaid choices. Any other design capable of sensing a posture variation of the body 10 and generating a corresponding sensing signal can be used.

Each tactile sensor 114 is adapted for measuring a surface change of the body 10 upon an external force and generating a corresponding sensing signal. Pressure sensor is the best choice for the tactile sensor 114 for sensing patting, digging, plugging, pulling, hitting, tweaking, etc. In actual application, the at least one tactile sensor 114 is not limited to the aforesaid choice. Any other design capable of sensing a surface change of the body 10 upon an external force and generating a corresponding signal can be used.

Each environmental sensor 116 is adapted for measuring changes in environmental conditions around the body 10 or the distance between the body 10 and an external object (for example, people, vehicle, or any other object), and then generating signals indicative of the changes in environmental conditions around the body 10 or the distance between the body 10 and the external object. The at least one environmental sensor 116 can be selected from the group of microphone array sensor, light sensor, air pressure sensor, proximity sensor and their combinations. The microphone array sensor measures voice volume, distance and azimuth of footsteps sound. The air pressure sensor measures the pressure change of the surroundings, for example: upstairs or downstairs. The light sensor is for sensing light change of the surroundings, for example: morning, daylight, evening or night. The proximity sensor is, similar to the microphone array sensor, for sensing the distance of a person. In actual application, the at least one environmental sensor 116 is not limited to the aforesaid choices. Any other design capable of measuring changes in environmental conditions around the body 10 or the distance between the body 10 and an external object e and generating a corresponding signal can be used.

More particularly, the combination of the various sensors of the sensor module 11 may be adjusted subject to application requirements. For example, if it simply needs to measure tracks, the at least one tactile sensor 114 and the at least one environmental sensor 116 can be omitted. Further, a combination of multiple 3D acceleration sensors can be used to simulate a gyroscope.

The data storage module 12 is mounted in the body 10, having stored therein multiple standard status parameters. Each standard status parameter has an accurate response signal. The data storage module 12 can be a hard disk drive or flash memory.

The output module 14 is mounted in the body 10. In this embodiment, the output module 14 is a speaker.

The processing unit 13 is mounted in the body 10, and electrically coupled with the sensor module 11 and the data storage module 12. When one or a number of the sensors of the sensor module 11 sensed a signal during an operation mode, as shown in FIG. 2, the processing unit 13 runs subject to the following steps:

S20 Receive the sensing signals;

S21 Process the sensing signals into an actual parameter;

S22 Receive the standard parameters from the data storage module;

S23 Match the actual parameter with the standard status parameters; and

S24 Output the matching accurate response signal to the output module when one of the standard status parameters matches the actual parameter.

In this embodiment, the standard status parameters are built in the data storage module. Every standard status is established by using the aforesaid sensors to generate different sensing signals and the aforesaid processing unit 13 to process the generated sensing signals. Every standard status parameter corresponds to one particular action or posture when the body 10 is being operated, for example: picking the body up onto the shoulder and then patting the body 10, holding the body 10 in hand and swinging it, or any other operations. When operating the body 10 for a particular action, the accurate response signal of the standard status parameter enables the output module 14 to make a corresponding response, answering the game player.

More particularly, when the game player picks the interactive electronic toy 1 up onto his(her) shoulders and pats the interactive electronic toy 1, the track sensor 110 of the sensor module 11 measures the angle and direction of the body 11 and the continuous track of the movement of the body 10, the posture sensor 112 measures the tilted posture of the body 10 at the game player's shoulder, the tactile sensor 114 measures the pressure of the patting action applied by the game player to the surface of the body 10, and so on. Thereafter, the processing unit 13 receives the respective multiple sensing signals and processes these sensing signals into the actual parameter. Then, the processing unit 13 matches these actual parameters with the standard status parameters in the data storage module 12. When one parameter is matched (for example, heavy hitting), the processing unit 13 outputs the corresponding accurate response signal (for example, painful) to the speaker, driving the speaker to generate a painful sound to remind the game player.

Figure 3:
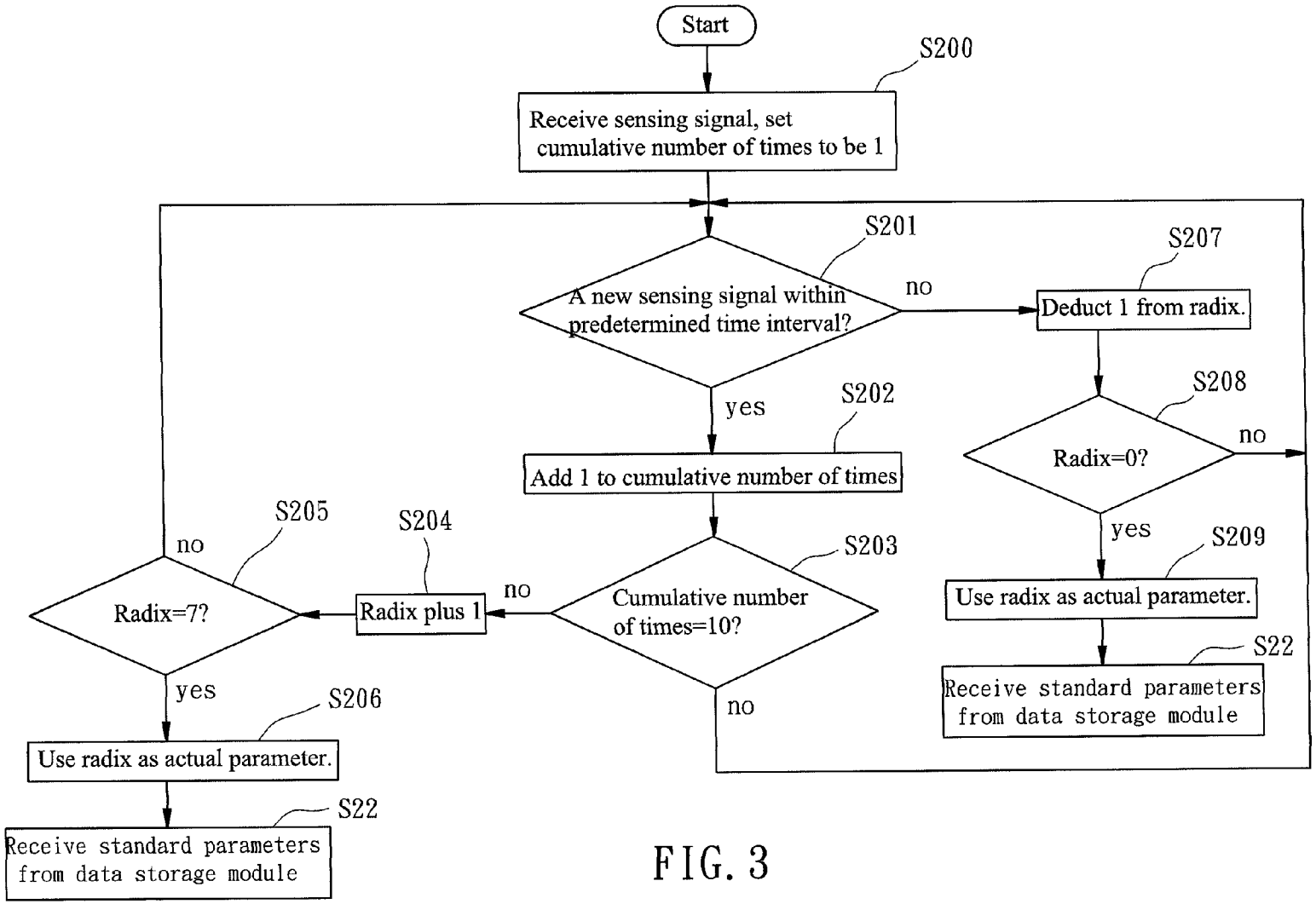
FIG. 3 is an operation flow of the processing unit of the interactive electronic toy in accordance with the present invention under the operation mode (II).
Figure 4:
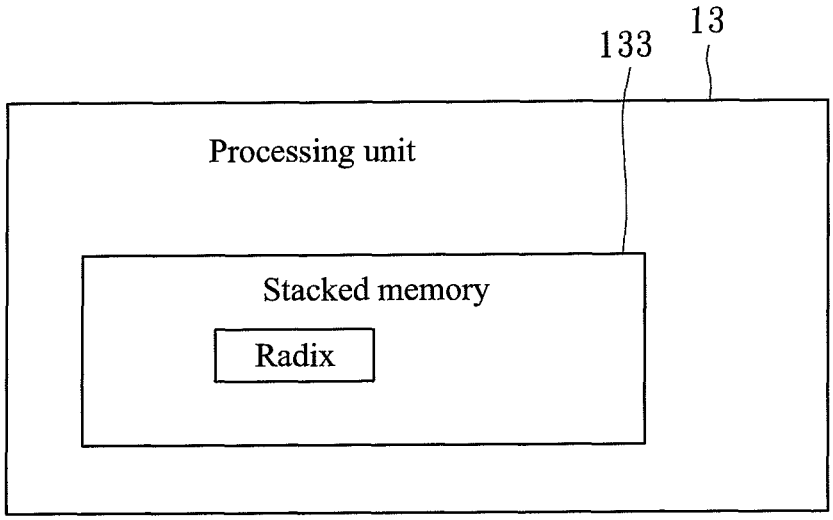
FIG. 4 is a block diagram of the processing unit of the interactive electronic toy in accordance with the present invention.

Referring to FIGS. 3 and 4, the processing unit 13 comprises a stacked memory 133 having built therein a radix, which is a positive integer. When the body 10 is being moved back and forth (for example, left and right, or, up and down), the processing unit 13 runs the steps S20 and S21 of the operation mode as follows:

S200 Receive the sensing signal generated by the sensor module, and set the cumulative number of times to be 1 (step S200). This means that the sensor module will generate the sensing signal in response to the first left-right shaking motion and provide the signal to the processing unit 13, and the processing unit 13 will, subject to the triggering of the sensing signal, set the cumulative number of times to be 1.

S201 Determine whether or not the sensor module generates the sensing signal again within a predetermined time interval? In this embodiment, the predetermined time interval is ≥0.5 second, or preferably, 0.5 second. This predetermined time interval means the time in which the processing unit 13 legally receives the sensing signal.

S202 Add 1 to the cumulative number of times for this sensing signal. It means that the body has been shacked again within the predetermined time interval (0.5 second), and the processing unit will add 1 to the cumulative number of times for this sensing signal.

S203 Determine whether or not the cumulative number of times has reached a predetermined first value? This predetermined first value is a positive integer. Preferably, this predetermined first value is 10. When the cumulative number of times reaches the predetermined first value, i.e., 10, proceed to step S204. If the cumulative number of times is not equal to the predetermined first value, i.e., 10, return to step S201.

S204 When the predetermined first value reaches 10, add 1 to the radix in the stacked memory 133. This means that the processing unit 13 will add 1 to the radix in the stacked memory 133 when the cumulative number of times of the sensing signal reaches 10.

S205 Determine whether or not the radix has reached a predetermined second value? This predetermined second value is a positive integer. Preferably, this predetermined second value is 7.

S206 When the predetermined second value is equal to 7, use the radix in the stacked memory 133 as the actual parameter for the execution of the next step S22. This means that the body has been continuously shacked left and right to the extent that the radix reaches 7 (the predetermined second value). When proceeding to step S24, the processing unit 13 outputs the accurate response signal to the speaker, driving the speaker to produce a blowing sound (for example, bottle opening sound). If the predetermined second value <7, for example, equal to 5, return to step S201 to determine whether or not the sensor module generates the sensing signal again within a predetermined time interval? And then proceed to step S202 when positive, or step S207 when negative.

S207 Deduct 1 from the radix in the stacked memory. Thus, the value of the radix becomes equal to 4. And then, return to step S201. The above steps are repeated again and again till that the radix in the stacked memory 133 is equal to 0.

S208 Determine whether or not the radix in the stacked memory 133 is equal to 0?

S209 Use the radix=0 as the actual parameter. This means the shacking motion of the body has been ended. Thereafter, return to Step S22. At this time, the processing unit 13 does not output the actual response signal to the speaker.

Further, the accumulation of the radix can be indicated by a LED module, i.e., the LED module can indicate the cumulative number of times of the radix by means of the number of its LED lights being lit.

In actual application, the aforesaid predetermined first value can be any other value, for example, 1 or 20; the predetermined second value can also be any other value, for example, 1 or 15. When the predetermined first value and the predetermined second value are smaller than the optimal value (for example, both equal to 1), it means the interactive electronic toy is more sensitive than the preferred embodiment, and the speaker will immediately produce a blowing sound when the body is being shacked. If the predetermined first value (equal to 20) and the predetermined second value (equal to 15) all surpass the optimal value, it means of the interactive electronic toy is less sensitive than the preferred embodiment, and the processing unit 13 will output the accurate response signal to the output module only when the body is shacked for a certain length of time. Therefore, the predetermined first value and the predetermined second value are limited to the preferred embodiment.

Thus, the interactive electronic toy 1 can interact with the game player positively. In actual application, when not many motion responses are necessary, the sensor module 11 can simply comprise one, two or three of the track sensor 110, posture sensor 112, tactile sensor 114 and environmental sensor 116, simplifying the design. Further, the output module 13 can use color variation of light or any other ways to remind the game player instead of the aforesaid speaker.

Figure 5:
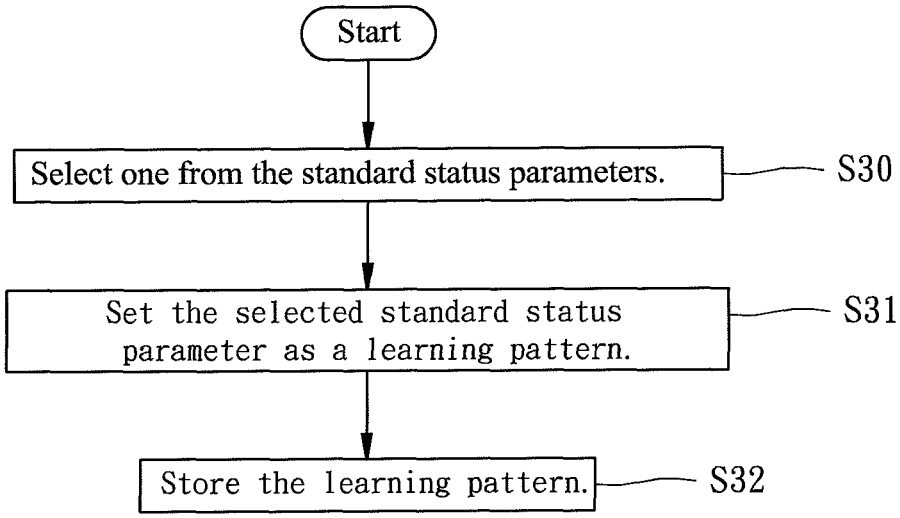
FIG. 5 is an operation flow of the processing unit of the interactive electronic toy in accordance with the present invention under a learning mode.

Referring to FIG. 5, an operation flow of the processing unit of the interactive electronic toy under a learning mode is shown. When the learning mode is selected, the processing unit 13 runs subject to the following steps:

S30 Select one from the standard status parameters.

S31 Set the selected standard status parameter as a learning pattern.

S32 Store the learning pattern.

When the learning mode is initiated, the processing unit 13 stops the operation mode, and the interactive electronic toy 1 simply enables the standard status parameter of the learning pattern and disables the other standard status parameters, i.e., the interactive electronic toy 1 simply makes a response to one particular action.

Figure 6:
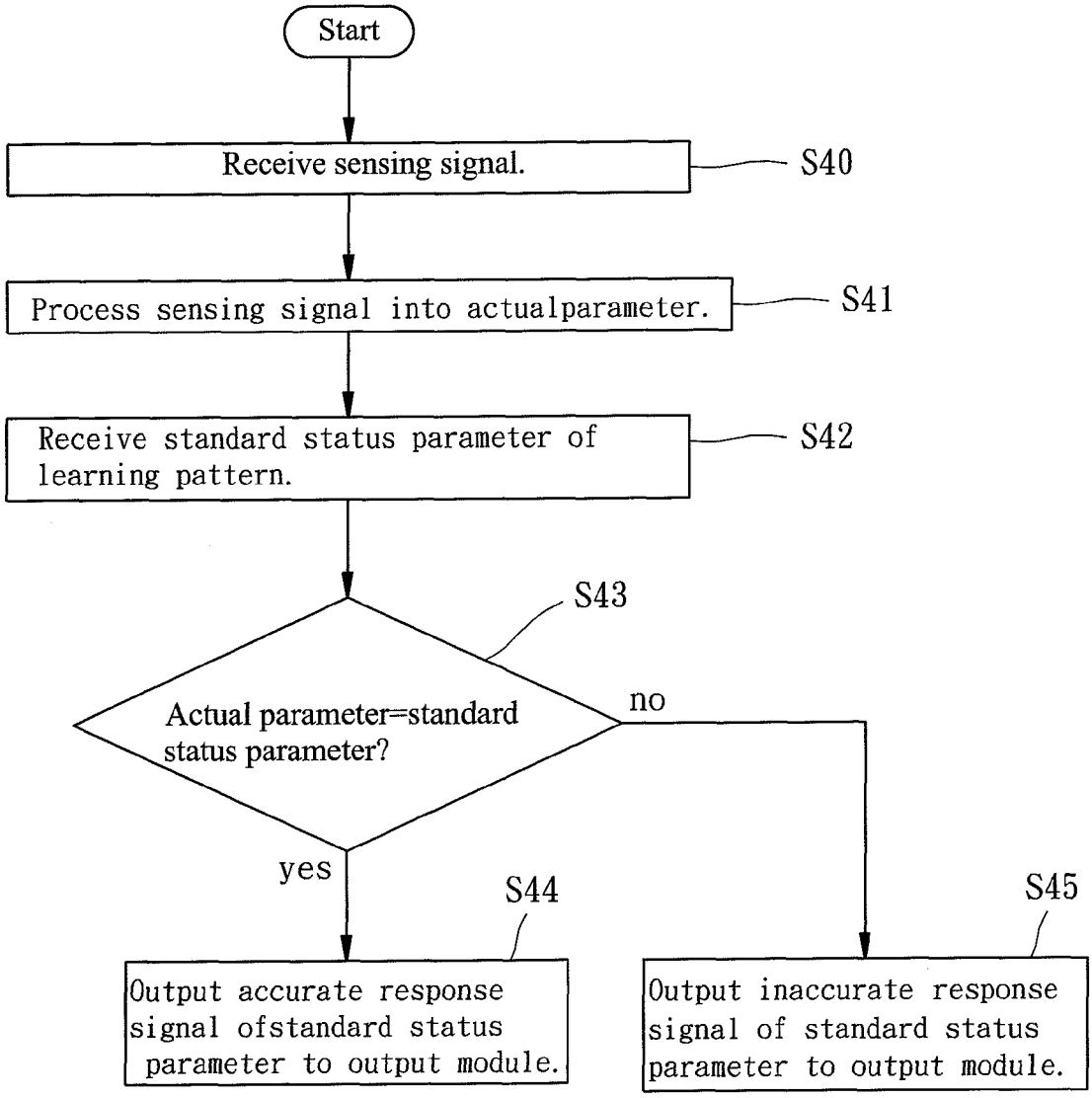
FIG. 6 is an operation flow of the processing unit of the interactive electronic toy in accordance with the present invention under an imitation mode.

Referring to FIG. 6, an operation flow of the processing unit of the interactive electronic toy under an imitation mode is shown. Further, every standard status parameter in the data storage module 12 comprises an inaccurate response signal. When the imitation mode is selected, the processing unit 13 runs subject to the following steps:

S40 Receive the sensing signals.

S41 Process the sensing signals into an actual parameter.

S42 Receive the standard status parameter of the learning pattern.

S43 Determine whether or not the actual parameter is equal to the standard status parameter? And then proceed to step S44 when positive, or step S45 when negative.

S44 Output the accurate response signal of the standard status parameter to the output module.

S45 Output the inaccurate response signal of the standard status parameter to the output module.

Thus, the game player can demonstrate the standard operation of the learning pattern to another game player for learning, and then invite this new game player to practice the interactive electronic toy, achieving imitation learning. Further, the interaction electronic toy can remind the game player the correctness of every motion imitation. For example, if the current learning pattern is to lift the right hand of the interactive electronic toy and the game player lifts the left hand of the interactive electronic toy, the inaccurate response signal of the standard status parameter will be outputted to the speaker (output module 14), driving the speaker to output the voice of "This is the left hand, try again, Go!" to remind the game player. If the game player lifts the right hand of the interactive electronic toy, the accurate response signal of the standard status parameter will be outputted to the speaker (output module 14) driving the speaker to output the voice of "Good job". The speaker will output a different sound subject to the accurate response signal or inaccurate response signal. However, it is to be understood that the content of the output sound is not limited to the aforesaid examples.

Figure 7:
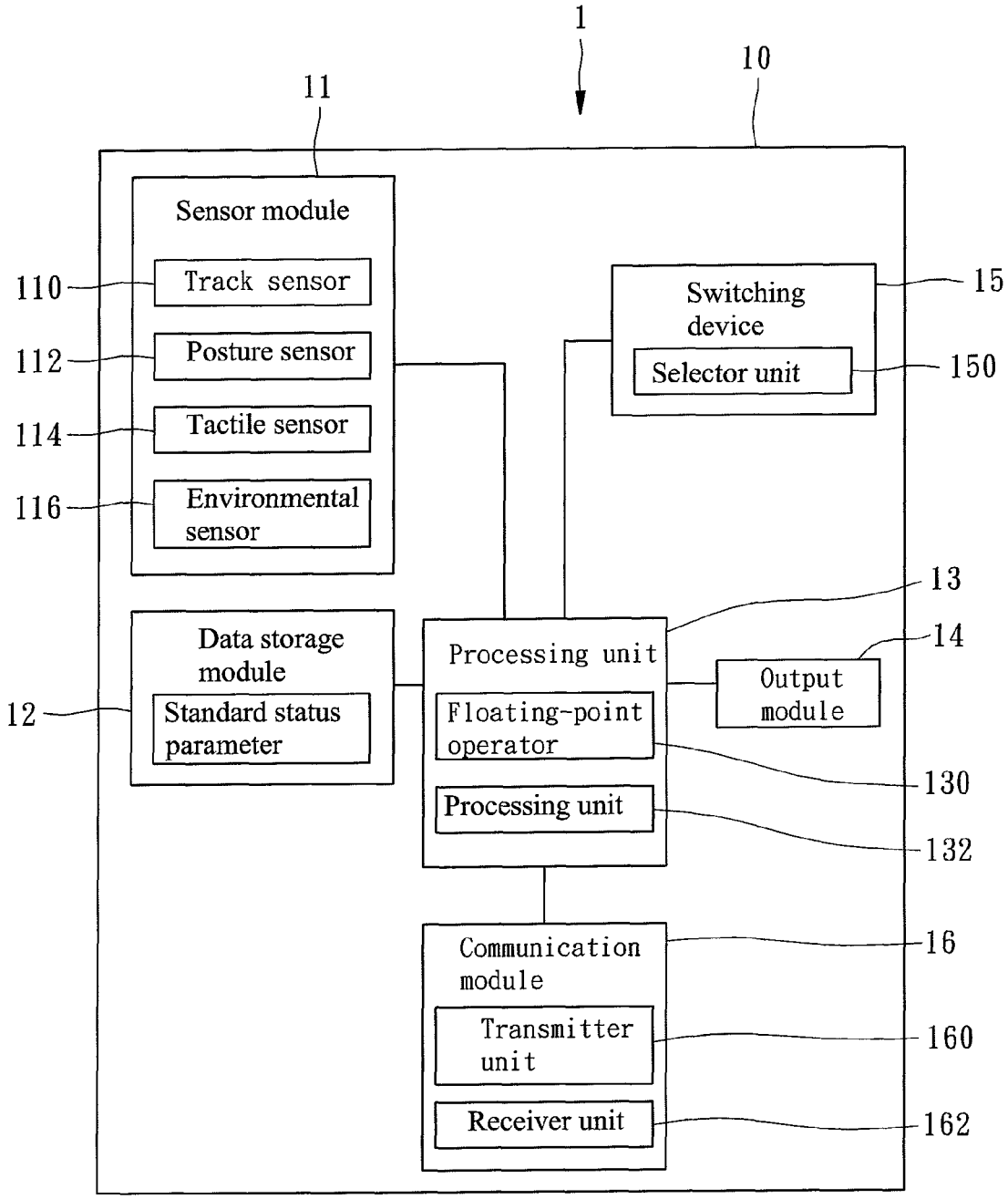
FIG. 7 is a block diagram of an alternate form of the interactive electronic toy in accordance with the present invention, illustrating a selector and a communication module included.

Referring to FIG. 7, the interactive electronic toy 1 further comprises a switching device 15 electrically coupled to the processing unit 13 for switching the processing unit 13 to one of the operation mode, the learning mode and the imitation mode, i.e., the processing unit 13 runs only one mode at a time. Thus, when the switching device 15 is switched to the operation mode, the processing unit 13 will run the flow shown in FIG. 2. When the switching device 15 is switched to the learning mode, the processing unit 13 will run the flow shown in FIG. 5. When the switching device 15 is switched to the imitation mode, the processing unit 13 will run the flow shown in FIG. 6. The switching device 15 can be an electronic switch, external switch or touch device (for example, touch screen).

The switching device 15 comprises a selector unit 150 for the selection of one of the standard status parameters under the learning mode. In case the switching device 15 is a touch screen, the touch screen will display multiple titles when switched to the learning mode. Each title corresponds to one respective standard status parameter. Subject to these titles, the game player can select the desired learning status.

Referring to FIG. 7, the processing unit 13 further comprises a floating-point operator 130 and a processor 132. The floating-point operator 130 is adapted for receiving the sensing signals and computing the sensing signals into an actual parameter. The processor 132 is adapted for matching the actual parameter with the standard status parameter of the learning pattern, and then outputting the accurate response signal or inaccurate response signal. Thus, the floating-point operator 130 can compute the sensing signal generated by the sensor module 11 at a high speed, and then provide the computed parameter to the processor 132 for matching, enabling the interactive electronic toy 1 to make a responses rapidly. In actual application, the processing unit 13 can simply use the floating-point operator 130 or processor 132 to execute computing and matching operations.

The interactive electronic toy 1 further comprises a communication module 16 electrically coupled to the processing unit 13. The communication module 16 comprises a transmitter unit 160 and a receiver unit 162. The transmitter unit 160 is adapted for transmitting the standard status parameter and the learning pattern by means of a predetermined communication protocol. The receiver unit 162 is adapted for receiving the standard status parameter and the learning pattern by means of the same communication protocol. The communication protocol can be, Bluetooth, wireless network, local area network, USB communication protocol. Thus, after setting of the learning pattern of the learning mode in a local interactive electronic toy 1, the learning pattern can be transmitted by the transmitter unit 160 of the communication module 16 of the local interactive electronic toy 1 to a remote interactive electronic toy and then stored in the data storage module 12 of the remote interactive electronic toy by the processing unit thereof, enabling the game player of the remote interactive electronic toy to practice the same learning pattern. Further, the local interactive electronic toy 1 can also transmit the standard status parameters by the communication module 16. In actual application, the local interactive electronic toy 1 can eliminate the communication module 16.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An interactive electronic toy, comprising:

a body;

a sensor module mounted in said body and adapted for generating multiple sensing signals in response to actions of said body being operated by a person;

a data storage module mounted in said body, said data storage module having multiple standard status parameters stored therein, each said standard status parameter comprising an accurate response signal;

an output module mounted in said body; and a processing unit mounted in said body and electrically coupled with said sensor module, said data storage module and said output module, the processing unit adapted for running an operation mode, said processing unit running said operation mode subject to the steps of:

receiving said sensing signals and processing said sensing signals into an actual parameter;

receiving said standard status parameters;

matching said actual parameter with said standard status parameters; and outputting to said output module the accurate response signal of one of said standard status parameter that matches said actual parameter;

wherein said processing unit comprises a stacked memory having built therein a radix, said radix being an integer, said processing unit processing said sensing signals into said actual parameter subject to the steps of:

receiving one said sensing signal generated by said sensor module and setting a cumulative number of times for the sensing signal to be 1;

determining whether or not said sensor module generates the sensing signal again within a predetermined time interval;

adding 1 to said cumulative number of times for the sensing signal when said sensor module generates the sensing signal again within a predetermined time interval;

adding 1 to the radix in said stacked memory when said cumulative number of times reaches a predetermined first value that is an integer, and using the radix in said stacked memory as an actual parameter when the value of the radix reaches a predetermined second value that is an integer;

deducing 1 from the radix in said stacked memory when said sensor module generates no sensing signal again within said predetermined time interval, and zero the number of times of the sensing signal that does not reach said predetermined first value; and using the radix in said stacked member as an actual parameter when said predetermined second value is zero, or repeatedly executing, or returning to the step of determining whether or not said sensor module generates the sensing signal again within said predetermined time interval when said predetermined second value is not zero.

2. The interactive electronic toy as claimed in claim 1, wherein said sensor module comprises at least one track sensor adapted for sensing a continuous track of a movement of said body and generating a continuous series of sensing signals corresponding to the movement of said body.

3. The interactive electronic toy as claimed in claim 1, wherein said sensor module comprises at least one posture sensor adapted for sensing postures of said body and generating corresponding sensing signals.

4. The interactive electronic toy as claimed in claim 1, wherein said sensor module comprises at least one tactile sensor adapted for measuring a surface change of said body upon an external force and generating a corresponding sensing signal.

5. The interactive electronic toy as claimed in claim 1, wherein said sensor module comprises at least one environmental sensor adapted for measuring changes in environmental conditions around said body or the distance between said body and an external object, and then generating signals indicative of the changes in environmental conditions around said body or the distance between said body and said external object.

6. The interactive electronic toy as claimed in claim 1, wherein said predetermined time interval is ≥0.5 second; said predetermined first value=10; said predetermined second value=7.

7. The interactive electronic toy as claimed in claim 1, wherein said processing unit comprises a floating-point operator and a processor electrically coupled to said floating-point operator, said floating-point operator being adapted for receiving said sensing signals and computing said sensing signals into an actual parameter, said processor being adapted for matching said actual parameter with said standard status parameters and then outputting the accurate response signal of the matched standard status parameter.

8. The interactive electronic toy as claimed in claim 1, wherein said processing unit being adapted for running a learning mode, said processing unit running said learning mode subject to the steps of:

selecting one from said standard status parameters;

setting the selected standard status parameter as a learning pattern; and storing said learning pattern.

9. An interactive electronic toy, comprising:

a body;

a sensor module mounted in said body and adapted for generating multiple sensing signals in response to actions of said body being operated by a person;

a data storage module mounted in said body, said data storage module having multiple standard status parameters stored therein, each said standard status parameter comprising an accurate response signal;

an output module mounted in said body; and a processing unit mounted in said body and electrically coupled with said sensor module, said data storage module and said output module, the processing unit adapted for running an operation mode, said processing unit running said operation mode subject to the steps of:

receiving said sensing signals and processing said sensing signals into an actual parameter;

receiving said standard status parameters;

matching said actual parameter with said standard status parameters; and outputting to said output module the accurate response signal of one of said standard status parameter that matches said actual parameter;

wherein each said standard status parameter further comprises an inaccurate response signal; said processing unit being adapted for running an imitation mode, said processing unit running said imitation mode subject to the steps of:

receiving said sensing signals;

processing said sensing signals into an actual parameter;

receiving the standard status parameter corresponding to said learning pattern;

matching the actual parameter with the standard status parameter; and outputting the accurate response signal of the standard status parameter to said output module when the actual parameter matches the standard status parameter, or the inaccurate response signal of the standard status parameter to said output module when not matched.

10. The interactive electronic toy as claimed in claim 9, further comprising a switching device electrically coupled to said processing unit for switching said processing unit to one of said operation mode, a learning mode and said imitation mode.

11. The interactive electronic toy as claimed in claim 10, wherein said switching device comprises a selector unit adapted for selecting one of said standard status parameters under said learning mode.

12. The interactive electronic toy as claimed in claim 8, wherein said processing unit comprises a floating-point operator and a processor electrically coupled to said floating-point operator, said floating-point operator being adapted for receiving said sensing signals and computing said sensing signals into an actual parameter, said processor being adapted for matching said actual parameter with said standard status parameters and then outputting the accurate response signal of the matched standard status parameter.

13. The interactive electronic toy as claimed in claim 8, further comprising a communication module electrically coupled to said processing unit, said communication module comprising a transmitter unit and a receiver unit, said transmitter unit being adapted for transmitting said learning pattern by means of a predetermined communication protocol, said receiver unit being adapted for receiving said learning pattern by means of said communication protocol.

14. The interactive electronic toy as claimed in claim 1, further comprising a communication module electrically coupled to said processing unit, said communication module comprising a transmitter unit and a receiver unit, said transmitter unit being adapted for transmitting said standard status parameters by means of a predetermined communication protocol, said receiver unit being adapted for receiving said standard status parameters by means of said communication protocol.

* * * * *